US006837722B2

(12) United States Patent
Sakamoto

(10) Patent No.: US 6,837,722 B2
(45) Date of Patent: Jan. 4, 2005

(54) CONNECTOR COVER

(75) Inventor: Rikio Sakamoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/372,299

(22) Filed: Feb. 25, 2003

(65) Prior Publication Data

US 2003/0162438 A1 Aug. 28, 2003

(30) Foreign Application Priority Data

Feb. 26, 2002 (JP) ..... 2002-049860

(51) Int. Cl.[7] ..... H01R 13/44
(52) U.S. Cl. ..... 439/135; 439/940
(58) Field of Search ..... 439/135, 136, 439/148–150, 940

(56) References Cited

U.S. PATENT DOCUMENTS 5,026,295 A * 6/1991 Fong et al. ..... 439/135
5,199,888 A * 4/1993 Condra et al. ..... 439/142
5,681,174 A * 10/1997 Correll et al. ..... 439/135
6,015,305 A * 1/2000 McHugh et al. ..... 439/135
6,135,795 A * 10/2000 Ho et al. ..... 439/135

FOREIGN PATENT DOCUMENTS

JP 3003691 B1 11/1999

* cited by examiner

*Primary Examiner*—Hien Vu
(74) *Attorney, Agent, or Firm*—Sughrue Mion, PLLC

(57) ABSTRACT

A connector cover of the present invention covers an opening of a connector. The connector cover includes a cover which covers the opening of the connector and an insertion which protrudes out from the cover and which is inserted into the opening. The connector cover has a chamfer which is provided at the end of the insertion, wherein the end is on the side from which the cover is lifted when the connector cover is removed from the connector.

15 Claims, 9 Drawing Sheets

1; CONNECTOR COVER 2; COVER 3; LIFTING SECTION
4; INSERTION 8; CHAMFER

1; CONNECTOR COVER 2; COVER 3; LIFTING SECTION
4; INSERTION 8; CHAMFER

11; CONNECTOR COVER 12; COVER 13; LIFTING SECTION
14,15; INSERTION 18; CHAMFER

21; CONNECTOR COVER 22; COVER 16; INSERTION
27; NOTCH

31; CONNECTOR COVER

101; CONNECTOR COVER 102; COVER 103; HANDLE
104; INSERTION 105; CONNECTOR 106; CONNECTION SECTION
107; NOTCH

201; CONNECTOR COVER 202; COVER 203; LIFTING SECTION
204; INSERTION 207; NOTCH

CONNECTOR COVER

BACKGROUND OF THE INVENTION

The present invention relates to a connector cover, and in particular, a connector cover used for a connector of a card edge type such as an expansion slot of a computer.

While the computers are used in various places, they are often installed in an environment unsuitable for installation. In such cases, contact failures may be caused by, for example, dirt stuck in an available expansion slot of the computer. Thus, a connector cover is used for a connector which is an unused available slot or the like to block its opening.

A card edge connector used, for example, for the available expansion slot or the like of a computer has an opening having a concave groove formed therein for mounting an apparatus having a card-shaped portion on which a connecting terminal is provided, such as various kinds of cards like a memory card for example. The connector cover for blocking such an opening of the card edge connector is proposed in Japanese Patent No. 3003691. FIG. 7 is a perspective view showing a configuration of this connector cover.

This connector cover 101 is made from an insulator material such as plastic, and has a cover 102, handles 103 and insertions 104. The cover 102 is formed in a rectangular plate, and a plurality of the handles 103 are placed at predetermined intervals in the longitudinal direction on the top surface of the cover 102. The cover 102 has the insertions 104 in the shape of a rectangular plate protruding out downward from the under surface thereof. A plurality of the insertions 104 are placed at predetermined intervals, facing the handles 103, in the longitudinal direction of the cover 102. The insertion 104 is formed, for example, to have a width equal to the interval of an inner wall of a connection section 106 in the shape of a concave groove of a card edge connector 105. A notch 107 extending in a direction orthogonal to the longitudinal direction of the cover 102 is provided between the handles 103 adjacent on the top surface of the cover 102. An appropriate number of the notches 107, for example, three notches 107, are spaced apart from one another in the longitudinal direction of the cover 102. The notch 107 is a V-shaped groove, for example, formed on the top surface of the cover 102, and has an appropriate depth from the top surface toward the under surface of the cover 102.

To attach such a conventional connector cover 101 on the card edge connector 105 for example, the insertions 104 formed on the under surface of the cover 102 are inserted into the connection sections 106 of the card edge connector 105 until the under surface of the cover 102 comes into contact with the top surface of the card edge connector 105. The connection sections 106 of the card edge connector 105 are covered by the cover 102. The insertions 104 of the connector cover 101 then come into contact with the inner walls of the connection sections 106 of the card edge connector 105, and are held by a frictional force between the inner walls and the insertions 104. In addition, to remove the connector cover 101, an operator holds and pulls up the handles 103 provided on the cover 102 so that the connector cover 101 comes off the card edge connector 105. The notches 107 are provided on the cover 102 to enable the connector cover 101 to be apply variable connectors. The initial connector cover 101 is in the shape of a string connected in the longitudinal direction, and the notch 107 is folded to separate the connector cover 101 for use depending on the length of the top surface of the card edge connector 105.

For the above-mentioned conventional connector cover 101, it is possible to integrate the handles 103 with the cover 102 to ease production of the connector cover 101.

Referring to FIG. 8, a cover 202 of such a connector cover 201 is in the shape of a rectangular plate, and an insertion 204 is in the shape of a rectangular plate protruding out downward from the under surface of cover 202 just like the connector cover 101 shown in FIG. 7. The cover 202 has one of its ends extended in the longitudinal direction so that, when the connector cover 201 is attached to the card edge connector 105, that end will protrude out of a side of the card edge connector 105. The protruding portion is a lifting section 203. In addition, an end surface of the insertion 204 standing vertical in the longitudinal direction of the cover 202 comes into contact with the inner wall of the card edge connector 105 so that, when mounted on the card edge connector 105, the connector cover 201 and the card edge connector 105 will not be deviated by moving relatively in the longitudinal direction. A notch 207 extending in a direction orthogonal to the longitudinal direction of the cover 202 is provided on the top surface of the cover 202 between the insertions 204, and the notch 207 is V-shaped groove for example.

To remove the conventional connector cover 201 as described above from the card edge connector 105, the operator holds and pulls up the lifting section 203 which is a protruding end of the cover 202 of the connector cover 201.

Referring to FIGS. 9*a* to 9*c*, when such a conventional connector cover 201 is removed from the card edge connector 105, a problem is created because the insertion 204 is torn by the boundary between the insertion 204 and the cover 202. More specifically, the lifting section 203 is pulled upward to remove the connector cover 201 from the card edge connector 105 as shown in FIG. 9*b* from the state shown in FIG. 9*a* in which the connector cover 201 is attached on the card edge connector 105. The head of the lifting section 203 of the cover 202 moves upward like an arc on the axis which is the notch 207. However, the surface, especially the lower part of the surface, vertical to the longitudinal direction of the insertion 204 near the lifting section 203 and the inner wall of the card edge connector 105 interfere. For this reason, if the lifting section 203 of the cover 202 is further lifted, a problem is caused because the insertion 204 mounted on the cover 202 is torn or split at the root, the boundary of the insertion 204 and the cover 202, as shown in FIG. 9*c*.

SUMMARY OF THE INVENTION

An object of the present invention is to provide a connector cover which neither impairs a positioning function to a connector nor makes an insertion tear or split from a cover when the connector cover is removed from the connector.

According to one aspect of the present invention, a connector cover, for covering an opening of a connector, is provided which includes: a cover which covers the opening of the connector; an insertion which protrudes out from the cover and which is inserted into the opening; and a chamfer which is provided at the end of the insertion, wherein the end is on the side from which the cover is lifted when the connector cover is removed from the connector.

According to another aspect of the present invention, a connector cover, for covering a plurality of openings of a connector, is provided which includes: a cover which covers the openings of the connector; a plurality of insertions which protrudes out from the cover, and each of which is inserted into one of the plurality of openings; and a chamfer which is provided at the end of at least one of the insertions, wherein the end is on the side from which the cover is lifted when the connector cover is removed from the connector.

BRIEF DESCRIPTION OF THE DRAWINGS

Other features and advantages of the invention will be made more apparent by the following detailed description and the accompanying drawings, wherein.

In the drawings, the same reference numerals represent the same structural elements.

DETAILED DESCRIPTION OF THE PREFERRED EMBODIMENTS

A first embodiment of the present invention will be described in detail below.

Figure 1:
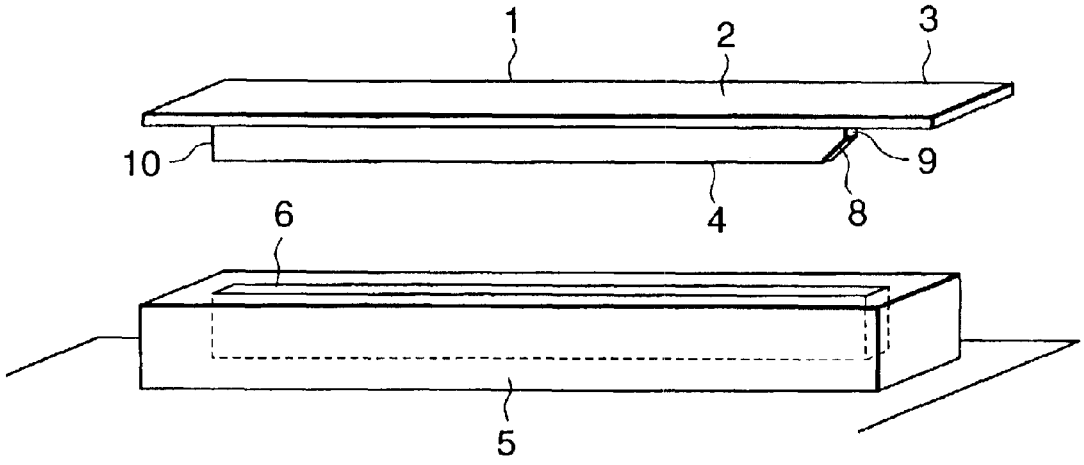
FIG. 1 is a perspective view showing a configuration of a connector cover according to a first embodiment of the present invention.

Referring to FIG. 1, a connector cover 1 of the present invention is made from an insulator material such as, for example, plastic or resin and includes a cover 2 and an insertion 4. The cover 2 and the insertion are molded or joined. The connector cover 1 lids a card edge connector 5 which is mounted in a substrate, in which a card or a board is inserted, and which connects the substrate and the card or the board electronically and physically. The shape of the cover 2 is a rectangular plate which covers the top surface of the card edge connector 5. The insertion 4 is inserted into a connection section 6 which is originally supposed to receive the card or the board. The shape of the insertion 4 is a rectangular plate protruding out downward from the under surface of the cover 2. The insertion 4 is formed, for example, to have a thickness equal to an interval of major inner walls of the connection section 6 of the card edge connector 5. The connection section 6 is a concave groove formed in the card edge connector 5. The cover 2 has a lifting section 3. The lifting section 3 is a protrusion which is one of the ends of the cover 2 overhanging in the longitudinal direction. When the connector cover 1 is connected to the card edge connector 5, the lifting section 3 juts sideward out of a top surface of the card edge connector 5. The insertion 4 has surfaces 9 and 10. The surfaces 9 and 10 of the insertion 4 stand vertical in the longitudinal direction of the cover 2 to come into contact with an each ends of the inner walls of the card edge connector 5. Therefore, the connector cover 1 and the card edge connector 5 will not slide nor slip by moving relatively in the longitudinal direction when the connector cover 1 is mounted on the card edge connector 5. The insertion 4 has a chamfer 8. The chamfer 8 is formed at a tip, that is, a corner of the end of the insertion 4 on the same side as the lifting section 3 is formed. For example, the chamfer 8 is formed by cutting a triangle prism from the edge of the insertion 4 on the same side of the lifting section 3. The cut out part is the triangle prism whose cross section has the shape of the isosceles triangle whose apex between the two equal sides is the edge of the insertion 4 when the cut out part is seen from a direction parallel with the under surface of the cover 2 and orthogonal to the longitudinal direction of the cover 2.

Next, the operation of this embodiment will be described.

In the case of removing the connector cover 1 from the card edge connector 5, the operator holds and pulls up the lifting section 3 upward, which is a protruding portion of the cover 2 of the connector cover 1. Then, the cover 2 of the connector cover 1 rotates on the axis, which is the other end of the lifting section 3, and moves upward. On the side of the lifting section 3 of the insertion 4, a surface 9, which is the side surface of the insertion 4 standing on the cover 2, is not chamfered, and works to settle the connector cover 1 by contacting to the inner wall of the connection section 6. However, since the edge of the insertion 4 is beveled and thus the chamfer 8 is formed thereon, when the lifting section 3 is lifted and the connector cover 1 is removed, the inner wall of the connection section 6 will not interfere with the edge of the insertion 4 on the side of the lifting section 3 and separation or removal of the connector cover 1 from the card edge connector 5 will not be blocked. In addition, when the connector cover 1 is forcibly removed from the card edge connector 5, the insertion 4 fixed or formed on the cover 2 will not be torn or split at the root, the boundary of the insertion 4 and the cover 2.

Next, a second embodiment of the present invention will be described in detail. Of the components shown in FIG. 2, the same components as those shown in FIG. 1 are given the same symbols, and detailed description thereof will be omitted.

Figure 2:
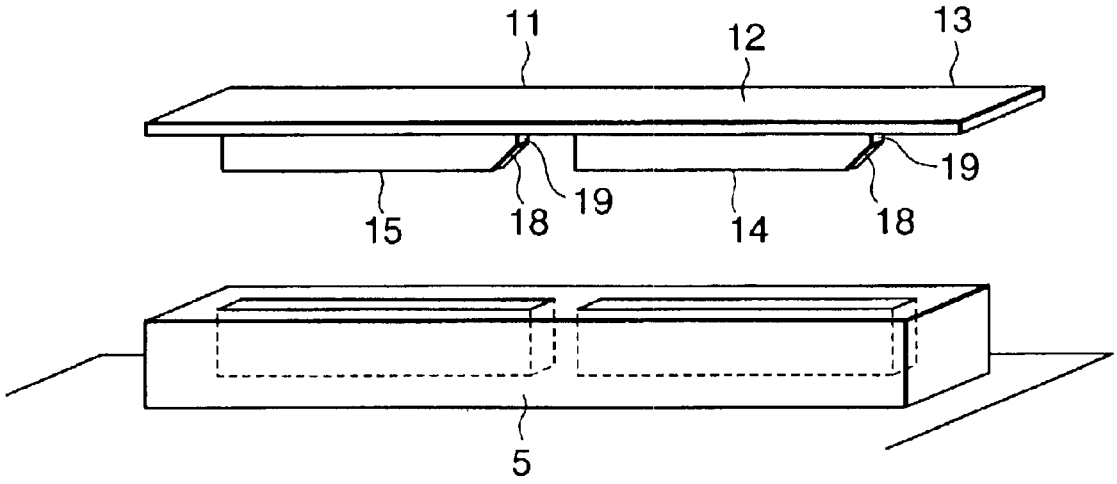
FIG. 2 is a perspective view showing a configuration of the connector cover according to a second embodiment of the present invention.

Referring to FIG. 2, a connector cover 11 of the second embodiment includes a cover 12 and a plurality of insertions 14 and 15. The cover 12 has a lifting section 13. The shape of each insertions 14 and 15 is a rectangular plate protruding out downward from the under surface of the cover 12. Each of the insertions 14 and 15 has a chamfer 18. Each of chamfers 18 is formed by cutting a triangular prism from each of the protruding rectangular solid and thus each of the insertions 14 and 15 are formed. The cut out fragment is a triangular prism whose one edge is the edge of the protruding rectangular solid on the side of the lifting section 13. In this embodiment, the chamfer 18 is formed every insertions 14 and 15.

When the lifting section 13 is held and pulled upward to remove the connector cover 11 of the second embodiment from the card edge connector 5, the cover 12 of the connector cover 11 moves upward in a circular movement on the pseudo-axis which is the end of the opposite side to the lifting section 13 in the longitudinal direction of the cover 12. End surfaces 19 of the insertions 14 and 15 on the side of the lifting section 13 standing vertically to the longitudinal direction of the cover 12 are in contact with the inner walls of the connection sections of the card edge connector 5, respectively. However, since the ends of the under surfaces of the insertions 14 and 15 on the sides of lifting sections 13 are chamfered, neither of the insertions 14 and 15 even on the side of the lifting sections 13 interferes with the inner walls of the connection sections of the card edge connector 5 when the cover 12 moves upward in an arc. For this reason, when the lifting section 13 is pulled upward to remove the connector cover 11 from the card edge connector 5, the insertions 14 and 15 formed on the cover 12 will not be torn or split at the root.

Next, a third embodiment of the present invention will be described in detail. Of the components shown in FIG. 3, the same components as those shown in FIG. 2 are given the same symbols, and detailed description thereof will be omitted.

Figure 3:
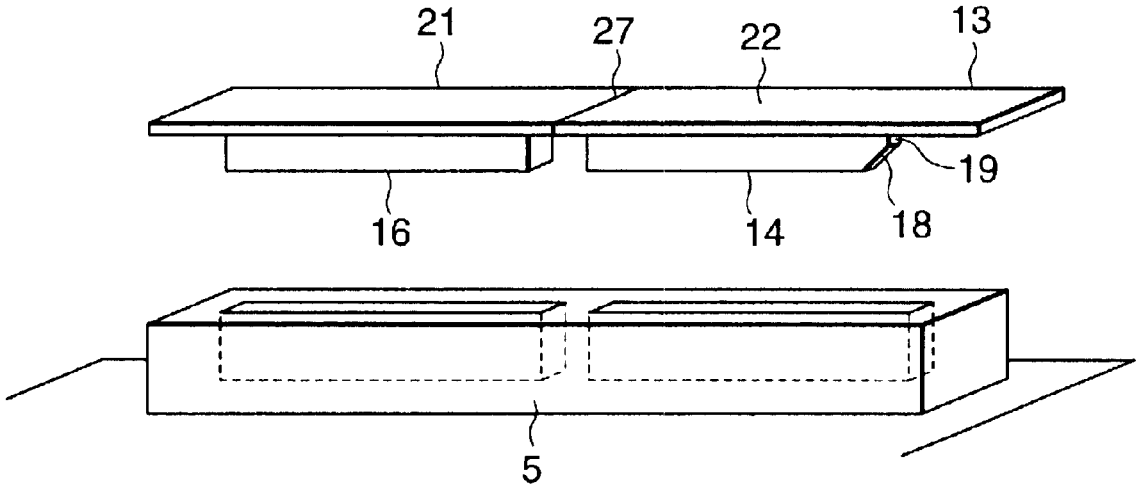
FIG. 3 is a perspective view showing a configuration of the connector cover according to a third embodiment of the present invention.

Referring to FIG. 3, a connector cover 21 of the third embodiment includes a cover 22 and the lifting section 13. The connector cover 21 has a plurality of insertions 14 and 16. The shape of each insertions 14 and 16 is rectangular plate protruding out downward from the under surface of the cover 22. The connector cover 21 has a notch 27 which is provided between the insertions 14 and 16 on the top surface of the cover 22, and lies from one side to another of the cover 22 extending in the direction orthogonal to the longitudinal direction of the cover 22. The notch 27 is for example a V-shaped groove which is formed on the top surface of the cover 22 and which has an appropriate depth from the top surface toward the under surface of the cover 22. The insertion 14, which is closest to the lifting section 13, has a chamfer 18. The chamfer 18 is formed by cutting a triangular prism from the protruding rectangular solid and thus the insertion 14 is formed. The cut out fragment is the triangular prism whose one edge is the edge of the protruding rectangular solid on the side of the lifting section 13.

When the lifting section 13 is held and pulled upward to remove the connector cover 21 of the third embodiment from the card edge connector 5, a portion of the cover 22 on the side of the lifting section 13 bordered with the notch 27 moves upward in an arc on the axis which is the notch 27. The end surface 19 of the insertion 14 standing vertically to the longitudinal direction of the cover 22 is in contact with the inner wall of the connection sections of the card edge connector 5. However, since the insertion 14 has the chamfer 18 at the end of the under surface thereof on the side of the lifting section 13, the insertion 14 does not interfere with the inner wall of the connection sections of the card edge connector 5 during the movement of the connector cover 21. For this reason, when the lifting section 13 is pulled upward to remove the connector cover 21 from the card edge connector 5, the insertion 14 formed on the cover 22 will not be torn or split at the root.

Next, a fourth embodiment of the present invention will be described in detail. Of the components shown in FIG. 4, the same components as those shown in FIG. 2 are given the same symbols, and detailed description thereof will be omitted.

Figure 4:
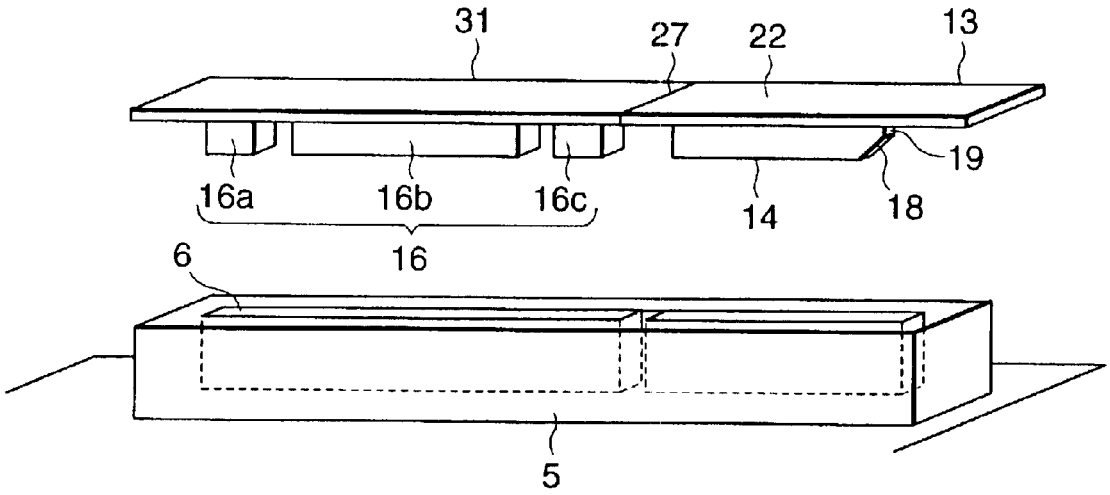
FIG. 4 is a perspective view showing a configuration of the connector cover according to a fourth embodiment of the present invention.

Referring to FIG. 4, a connector cover 31 has a cover 22, a lifting section 13 and a notch 27. The connector cover 31 has a plurality of insertions 14 and 16 as in the third embodiment. The insertions 14 and 16 are provided on the under surface of the cover 22. The shape of each insertions 14 and 16 is a rectangular plate protruding out downward from the under surface of the cover 22. The insertion 16 has three projections 16*a*, 16*b* and 16*c* which are to be inserted into a single concave groove of the connection section 6 of the card edge connector 5. The notch 27 is provided on the top surface of the cover 22 between the insertions 14 and 16, and lies from one side to another of the cover 22 extending in the direction orthogonal to the longitudinal direction of the cover 22 as in the third embodiment. The notch 27 is for example a V-shaped groove which is formed on the top surface of the cover 22 and which has an appropriate depth from the top surface toward the under surface of the cover 22. The insertion 14, which is closest to the lifting section 13, has a chamfer 18. The chamfer 18 is formed by cutting a triangular prism from the protruding rectangular solid and thus the insertion 14 is formed. The cut out fragment is the triangular prism whose one edge is the edge of the protruding rectangular solid on the side of the lifting section 13.

When the lifting section 13 is held and pulled upward to remove the connector cover 31 of the fourth embodiment from the card edge connector 5, a portion of the cover 22 on the side of the lifting section 13 bordered with the notch 27 moves upward in an arc on the axis which is the notch 27. The end surface 19 of the insertion 14 standing vertically to the longitudinal direction of the cover 22 is in contact with the inner wall of the connection sections of the card edge connector 5. However, since the insertion 14 has the chamfer 18 provided at the end of the under surface thereof on the side of the lifting section 13, the insertion 14 does not interfere with the inner wall of the connection sections of the card edge connector 5 during the movement of the connector cover 31. For this reason, when the lifting section 13 is pulled upward to remove the connector cover 31 from the card edge connector 5, the insertion 14 formed on the cover 22 will not be torn or split at the root.

Figure 5:
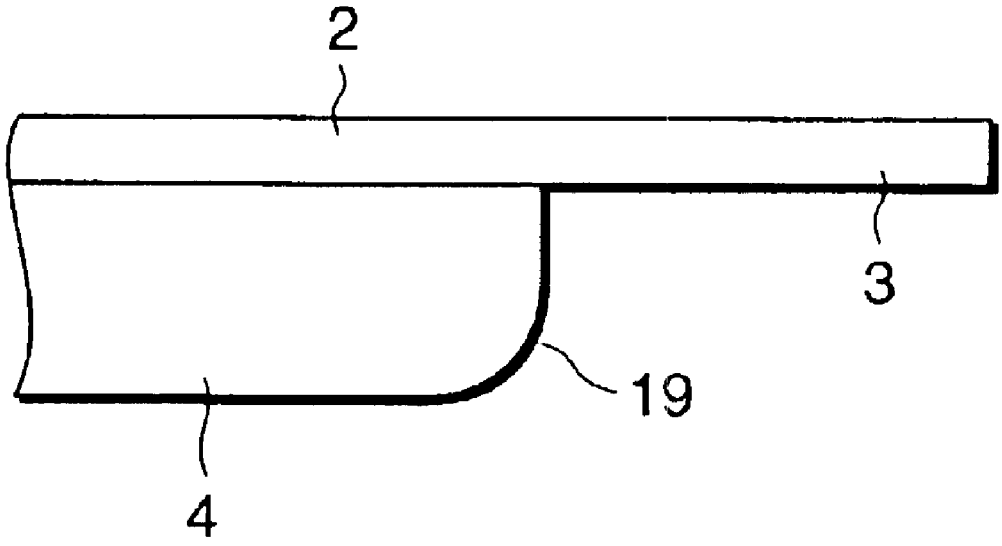
FIG. 5 is an enlarged view showing another embodiment of a chamfer of the connector cover according to the present invention.
Figure 6:
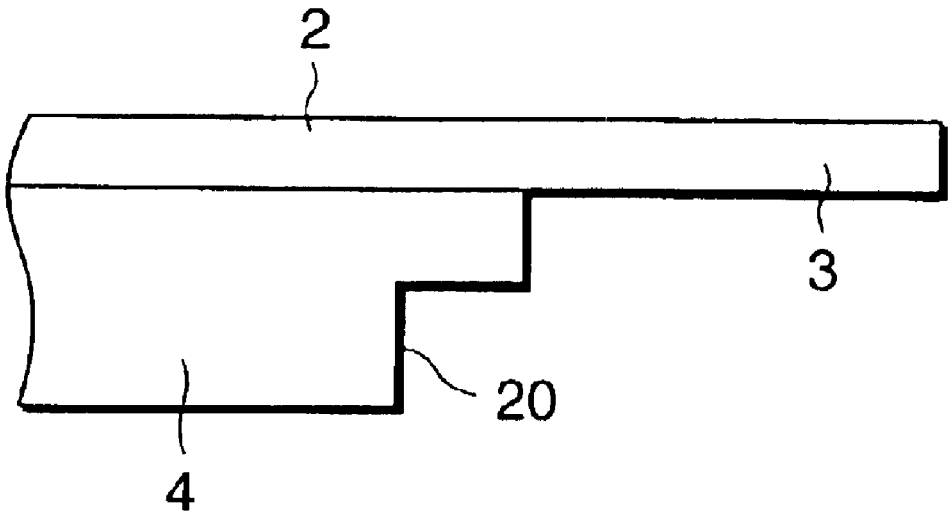
FIG. 6 is an enlarged view showing another embodiment of a chamfer of the connector cover according to the present invention.
Figure 7:
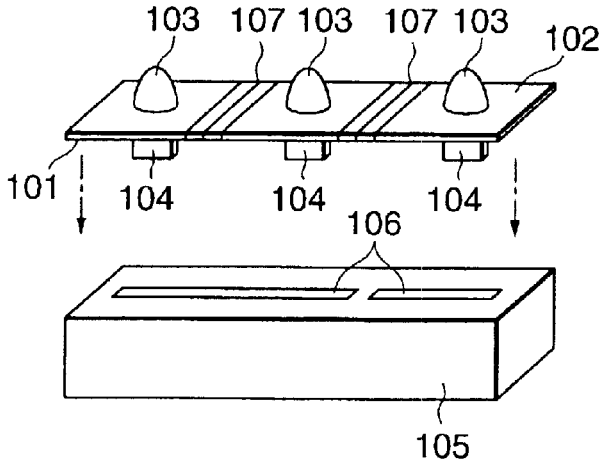
Fig.7 PRIOR ART
FIG. 7 is a perspective view showing a configuration of a conventional connector cover and connector.
Figure 8:
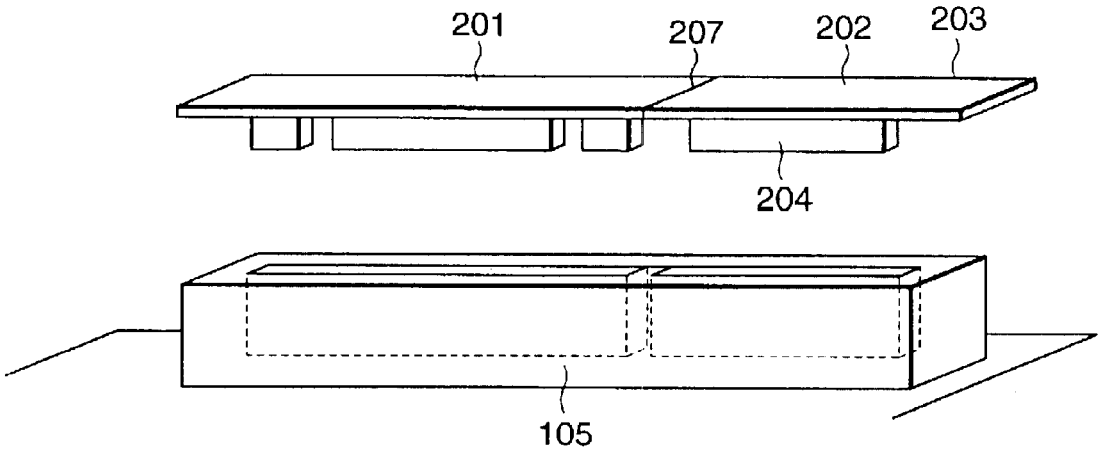
Fig.8 PRIOR ART
FIG. 8 is a perspective view showing a configuration of the connector cover of the past having a covering section integrated with a handle section.
Figure 9A:
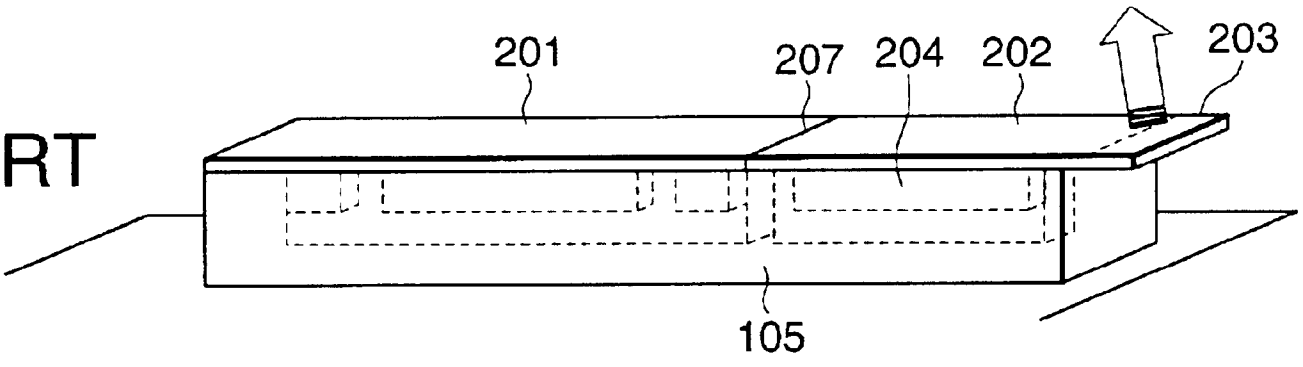
Fig.9a PRIOR ART
FIGS. 9*a* to 9*c* are perspective views showing a state of having the conventional connector cover shown in FIG. 7 removed from the connector in order of the steps thereof.
Figure 9B:
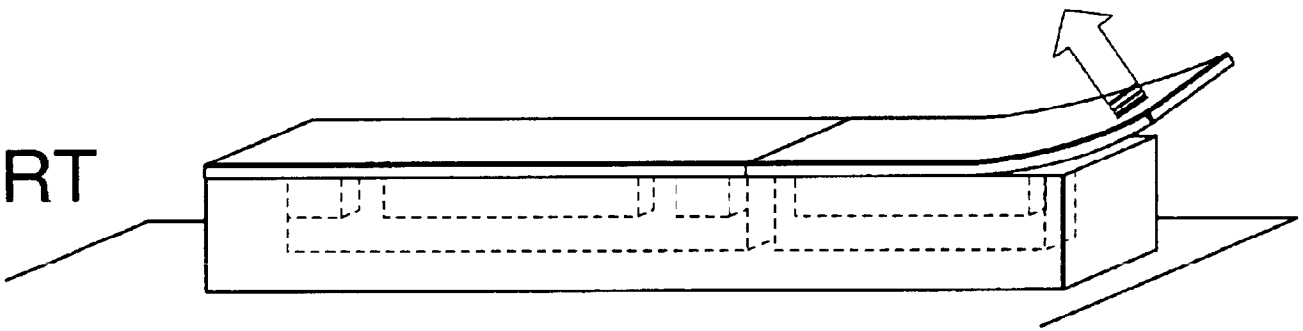
Fig.9b PRIOR ART
Figure 9C:
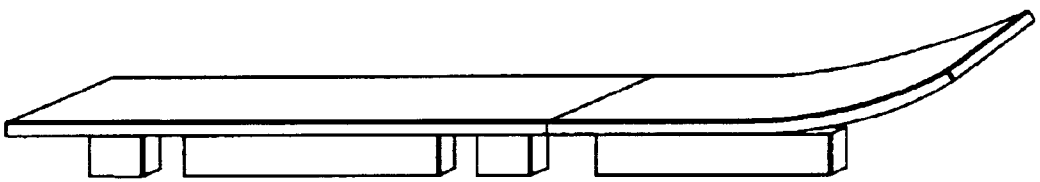
Fig.9c PRIOR ART

While the chamfer described above is formed by cutting a triangular prism from the protruding rectangular solid on the cover and the cut out fragment is the triangular prism whose one edge is the edge of the protruding rectangular solid on the side of the lifting section 13 in any of the above-mentioned first to fourth embodiments, it is not limited thereto. A chamfer 19 may be formed, for example, by cutting the edge of the protruding rectangular solid on the cover and a cut-out corner of the protruding rectangular solid forms a curved surface as shown in FIG. 5. In addition, a chamfer 20 may be formed by cutting a rectangular parallelepiped from the edge of the protruding rectangular solid on the cover as shown in FIG. 6.

Moreover, while the connector to have the connector cover attached thereto was described as the card edge connector in the above-mentioned embodiments, it is not limited thereto. The connector cover according to the present invention may be adopted for all the connectors capable of having the connector cover attached thereto.

As described in detail above, the connector cover according to the present invention has the insertion inserted into the connector which will not interferes with the inner wall of the connector when the end of the connector cover is lifted to remove from the connector. More specifically, in the present invention, a chamfer which is provided at the end of the insertion, wherein the end is on the side from which the cover is lifted when the connector cover is removed from the connector. As a result, the boundary of the connector cover between the insertion and the cover will not be torn or split.

While this invention has been described in conjunction with the preferred embodiments described above, it will now be possible for those skilled in the art to put this invention into practice in various other manners.

What is claimed is:

1. A connector cover for covering an opening of a connector, comprising:

a cover which covers said opening of said connector;

an insertion which protrudes out from said cover and which is inserted into said opening; and a chamfer which is provided at an end of said insertion, wherein said end is on a side from which said cover is lifted when said connector cover is removed from said connector, and wherein the chamfer is formed such that the chamfer does not block the removal of the cover from the connector when the cover is lifted from the connector.

2. The connector cover as claimed in claim 1, wherein said cover and said insertion are joined.

3. The connector cover as claimed in claim 1, wherein said chamfer is a curved surface.

4. The connector cover as claimed in claim 1, wherein said insertion includes a protruding rectangular solid, and said chamfer is formed by cutting a triangular prism from the protruding rectangular solid.

5. The connector cover as claimed in claim 1, wherein said insertion includes a protruding rectangular solid, and said chamfer is formed by cutting a rectangular parallelepiped from the protruding rectangular solid.

6. The connector cover as claimed in claim 1, wherein said connector cover is applied to a card edge type connector.

7. A connector cover for covering a plurality of openings of a connector, comprising:

a cover which covers said openings of said connector;

a plurality of insertions which protrudes out from said cover, and each of which is inserted into one of said plurality of openings; and a chamfer which is provided at an end of at least one of said insertions, wherein said end is on a side from which said cover is lifted when said connector cover is removed from said connector, and wherein the chamfer is formed such that the chamfer does not block the removal of the cover from the connector when the cover is lifted from the connector.

8. The connector cover as claimed in claim 7, wherein said cover includes a folding section where said cover folds, wherein said folding section is formed between the insertions.

9. The connector cover as claimed in claim 7, wherein said cover and said insertion are joined.

10. The connector cover as claimed in claim 7, wherein said chamfer is a curved surface.

11. The connector cover as claimed in claim 7, wherein said insertion includes a protruding rectangular solid, and said chamfer is formed by cutting a triangular prism from the protruding rectangular solid.

12. The connector cover as claimed in claim 7, wherein said insertion includes a protruding rectangular solid, and said chamfer is formed by cutting a rectangular parallelepiped from the protruding rectangular solid.

13. The connector cover as claimed in claim 7, wherein said connector cover is applied to a card edge type connector.

14. The connector cover as claimed in claim 7, wherein said chamfer is formed in every insertions.

15. The connector cover as claimed in claim 7, wherein said chamfer is formed in one of the closest insertions of said insertions to the side from which said cover is lifted when said connector cover is removed from said connector.

* * * * *